US005976751A

United States Patent [19]

Morinishi et al.

[11] Patent Number: 5,976,751

[45] Date of Patent: Nov. 2, 1999

[54] ELECTROPHOTOGRAPHIC PRINTING-USE TONER

[75] Inventors: Yasuharu Morinishi, Tenri; Tadashi Nakamura, Nara; Hitoshi Nagahama, Uji; Satoshi Ogawa, Yamatokoriyama; Toshihisa Ishida, Kashiba; Takeaki Ohuchi, Shiki-gun, all of Japan

[73] Assignee: Sharp Kabushiki Kaisha, Osaka, Japan

[21] Appl. No.: 09/057,049

[22] Filed: Apr. 8, 1998

[30] Foreign Application Priority Data

Apr. 18, 1997 [JP] Japan ..... 9-102161

[51] Int. Cl.[6] ..... G03G 9/097

[52] U.S. Cl. ..... 430/110; 430/111; 430/137; 430/106.6

[58] Field of Search ..... 430/110, 111, 430/137

[56] References Cited

U.S. PATENT DOCUMENTS

| | | | |
|---|---|---|---|
| 3,674,736 | 7/1972 | Lerman et al. | 430/111 |
| 4,345,015 | 8/1982 | Hendriksma et al. | 430/111 |
| 4,672,018 | 6/1987 | Berkes et al. | 430/111 |
| 4,895,785 | 1/1990 | Torimoto et al. | 430/111 |
| 4,933,251 | 6/1990 | Ichimura et al. | 430/111 |
| 4,996,126 | 2/1991 | Anno et al. | 430/110 |
| 5,499,083 | 3/1996 | Inoue et al. | 430/106.6 |

FOREIGN PATENT DOCUMENTS

| | | |
|---|---|---|
| 334 099 | 9/1989 | European Pat. Off. . |
| 860 745 | 8/1998 | European Pat. Off. . |
| 63-208862 | 8/1988 | Japan . |
| 1-185556 | 7/1989 | Japan . |
| 6-110246 | 4/1994 | Japan . |

*Primary Examiner*—Roland Martin
*Attorney, Agent, or Firm*—David G. Conlin; William J. Daley, Jr.

[57] ABSTRACT

The present invention provides electrophotographic printing-use toner capable of producing a quality image, without depending on excessive addition of a fluidizing agent, even after maintained at high temperature which causes toner to aggregate. The electrophotographic printing-use toner constituting two-component developer with magnetic powder carrier, made of a toner mother particle including binding agent synthetic resin and a coloring agent, whose surface is added with a fluidizing agent is manufactured so that a ratio of $\Delta Q_h/\Delta Q_s$ is not less than 0.37, more preferably not less than 0.45, where $\Delta Q_s$ is a charging rate of the toner mother particle, at a start of mixing with respect to the magnetic powder carrier, maintained at normal temperature, and $\Delta Q_h$ is a charging rate of the toner mother particle, at the start of mixing, maintained under a condition of temperature and time which causes the electrophotographic printing-use toner to aggregate.

8 Claims, 1 Drawing Sheet

ELECTROPHOTOGRAPHIC PRINTING-USE TONER

FIELD OF THE INVENTION

The present invention relates to electrophotographic printing-use toner for use in developing an electrostatic latent image formed on a photoreceptor, which constitutes two-component developer with magnetic powder carrier.

BACKGROUND OF THE INVENTION

A developing method wherein friction charging is generated by mixing and stirring electrophotographic printing-use toner (referred to as toner hereinafter) with magnetic powder carrier (referred to as carrier hereinafter) such as ferrite carrier, and the mixture of toner and carrier is held on a magnetic roller in a brush-shape so as to transfer the toner onto an electrostatic latent image formed on a photoreceptor by an electrostatic force, namely, the magnetic brush method has been widely known as one of the methods for developing an electrostatic image by toner.

Developer which is adopted in the magnetic brush method such as above is two-component developer composed of toner and carrier, wherein toner has a function of making an electrostatic latent image formed on the photoreceptor into a visible image, and carrier has a function of supplying charge to the toner by friction charging and transferring the toner onto a development region.

Toner is mostly made of binding agent synthetic resin (binding resin), and a charge control agent, coloring agent, a parting agent, and other agents are dispersed in the binding agent synthetic resin so as to form a toner mother particle, and a fluidizing agent is added onto the surface of the toner mother particle.

To explain briefly the function of the above materials constituting toner, (1) the binding agent synthetic resin gives binding, stability, and friction charging characteristics, (2) the coloring agent gives color and a friction charging characteristic, (3) the charge control agent gives a friction charging characteristic, (4) the parting agent gives a cleaning characteristic and prevents fixing offset, and (5) the fluidizing agent gives fluidity, friction charging, and cleaning characteristics.

Incidentally, in the magnetic brush method, a problem of so-called fogging in which toner is spread to a non-image region is one of the most important problems to be solved in order to realize a quality image. In particular, recently, in response to a long distance shipping of toner, for example, in exporting, a problem of fogging caused by exposure to high temperature during shipment has been increasing.

It is speculated that the fogging is generated in toner which is exposed to high temperature as a result of aggregation of toner which occurs at high temperature.

Namely, when a toner particle adheres to another toner particle by aggregation, each toner contacting with another toner particle lose a surface area for contacting with carrier by the area making a contact with another toner, and the charging ability of the toner by friction charging is deteriorated by the amount of the lost surface area. When toner whose charging ability is deteriorated by the aggregation is replenished into the developer tank, the toner is released out of the developer tank without being sufficiently charged by the friction with the carrier. The toner released out of the developer tank with insufficient charging is not properly guided to the image region on the photoreceptor since the electrostatic force, generated by the development electric field, acting on such toner is small. As a result, the toner adheres to the non-image region and causes the fog to generate.

Thus, it can be said that preventing the deterioration of charging ability caused by the aggregation of toner at high temperature is important in finding means to solve the problem of the fog phenomenon.

Conventionally, as such means for solving the fog phenomenon, a method for adding the fluidizing agent onto the surface of the toner mother particle in excess which is more than the amount added to obtain sufficient fluidity at normal temperature has been widely adopted. Specifically, a large amount of fluidizing agent exceeding 0.40 part by weight is added with respect to 100 parts by weight of toner mother particles.

However, in the above conventional method for preventing deterioration of charging ability caused by aggregation of toner at high temperature, by adding a large amount of fluidizing agent, the charging ability of the toner mother particles is greatly changed, and the following problem is presented.

That is, in the case of adding a large amount of fluidizing agent whose polarity is opposite to that of the toner mother particle, a large amount of fluidizing agent having the opposite polarity is included in the toner. The fluidizing agent having the opposite polarity lowers the charging ability of the toner, and causes fog or scattering of toner to generate regardless of the presence or absence of high temperature.

On the other hand, in the case of adding a large amount of fluidizing agent having the same polarity as that of the toner mother particle, the charging ability of the toner is increased too much, and lowering of image density is induced during running.

SUMMARY OF THE INVENTION

It is an object of the present invention to provide electrophotographic printing-use toner capable of preventing deterioration of charging ability of toner at high temperature and producing an image with a reduced fog level even when exposed to high temperature, without inducing fogging, scattering of toner, and lowering of image density which are caused by adding a large amount of fluidizing agent.

In order to achieve the above-mentioned object, first electrophotographic printing-use toner in accordance with the present invention includes toner mother particles including binding resin and a coloring agent, a fluidizing agent added onto surfaces of the toner mother particles, and magnetic powder carrier which constitutes two-component developer with the toner mother particles, wherein a ratio of $\Delta Q_h/\Delta Q_s$ is not less than 0.37, $\Delta Q_s$ being a charging rate of the toner mother particles maintained at normal temperature with respect to the magnetic powder carrier at a start of mixing, $\Delta Q_h$ being a charging rate of the toner mother particles, at a start of mixing, maintained under a condition of temperature and time which causes the electrophotographic printing-use toner to aggregate.

Fogging is generated in electrophotographic printing-use toner because the charging ability of the electrophotographic printing-use toner is lowered by aggregation.

With the described arrangement, the ratio of charging rising rates before and after maintaining the toner mother particles at high temperature is specified. This allows the charging ability to be sufficiently maintained even when exposed to high temperature. As a result, it is possible to prevent fogging from generating in a use after the toner is maintained at high temperature, without adding an excessive amount of fluidizing agent which has been done conventionally.

Second electrophotographic printing-use toner in accordance with the present invention includes toner mother particles including binding resin and a coloring agent, a fluidizing agent added onto surfaces of the toner mother particles, and magnetic powder carrier which constitutes two-component developer with the toner mother particles, wherein a ratio of $S_r/S_i$ is not more than 3.50, $S_i$ being a specific surface area of a group of the toner mother particles, which is obtained by measuring a volume sphere equivalent diameter of each of the toner mother particles with respect to the group of the toner mother particles, and by calculating a surface area as a sphere having a diameter of the volume sphere equivalent diameter, $S_r$ being a specific surface area of the group of the toner mother particles as measured by a BET method. When more irregularities are found on the surfaces of the toner mother particles, when exposed to high temperature, adjacent toner mother particles are more likely to be deformed in accordance with the irregularities, and the irregularities between adjacent toner mother particles are interlocked. When the temperature returns to normal, the adjacent toner mother particles interlocked by the irregularities are combined with each other at the interface, resulting in aggregation. On the other hand, when the surfaces of the toner mother particles are smooth with less irregularities, adjacent toner mother particles are less likely to be interlocked by the irregularities, and the fluidity is maintained even at high temperature so that aggregation is less likely to occur.

With the described arrangement, since the smoothness of the surfaces of the toner mother particles are specified, even when exposed to high temperature, toner is less likely to aggregate. Thus, it is possible to prevent fogging from generating in a use after the toner is maintained at high temperature, without adding an excessive amount of fluidizing agent which has been done conventionally.

For a fuller understanding of the nature and advantages of the invention, reference should be made to the ensuing detailed description taken in conjunction with the accompanying drawings.

DESCRIPTION OF THE EMBODIMENTS

Figure 1:
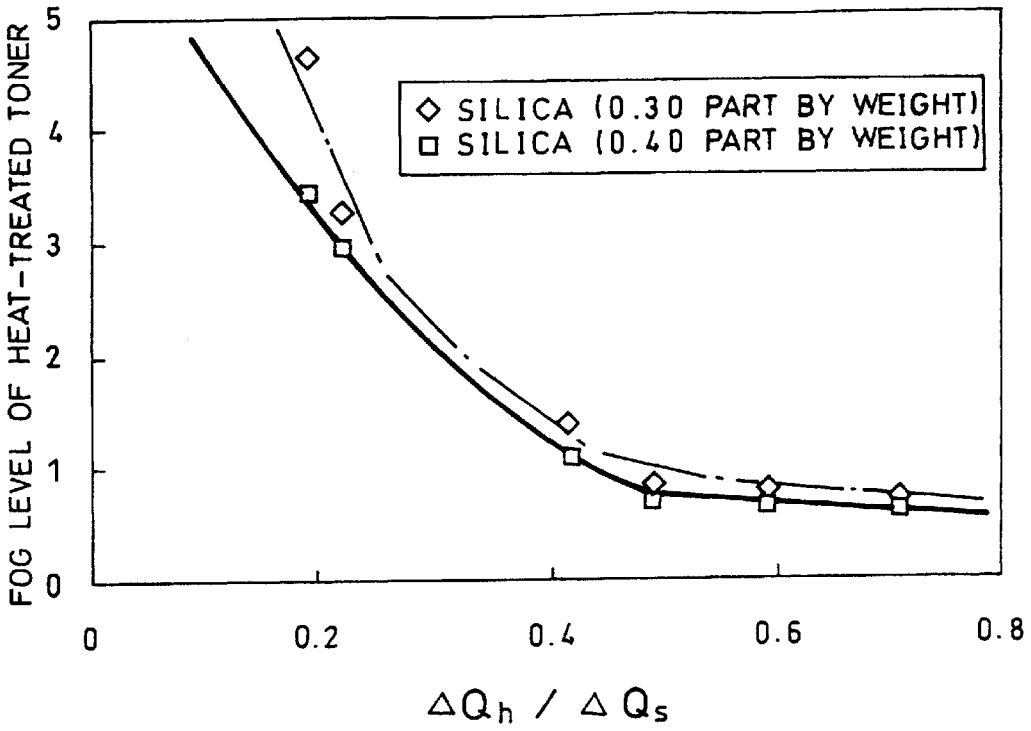
FIG. 1 is a graph of a fog level of heat-treated toner versus $\Delta Q_h/\Delta Q_s$ which is a ratio of charging rising rates before and after subjecting toner to high temperature, in electrophotographic printing-use toner of the present invention.
Figure 2:
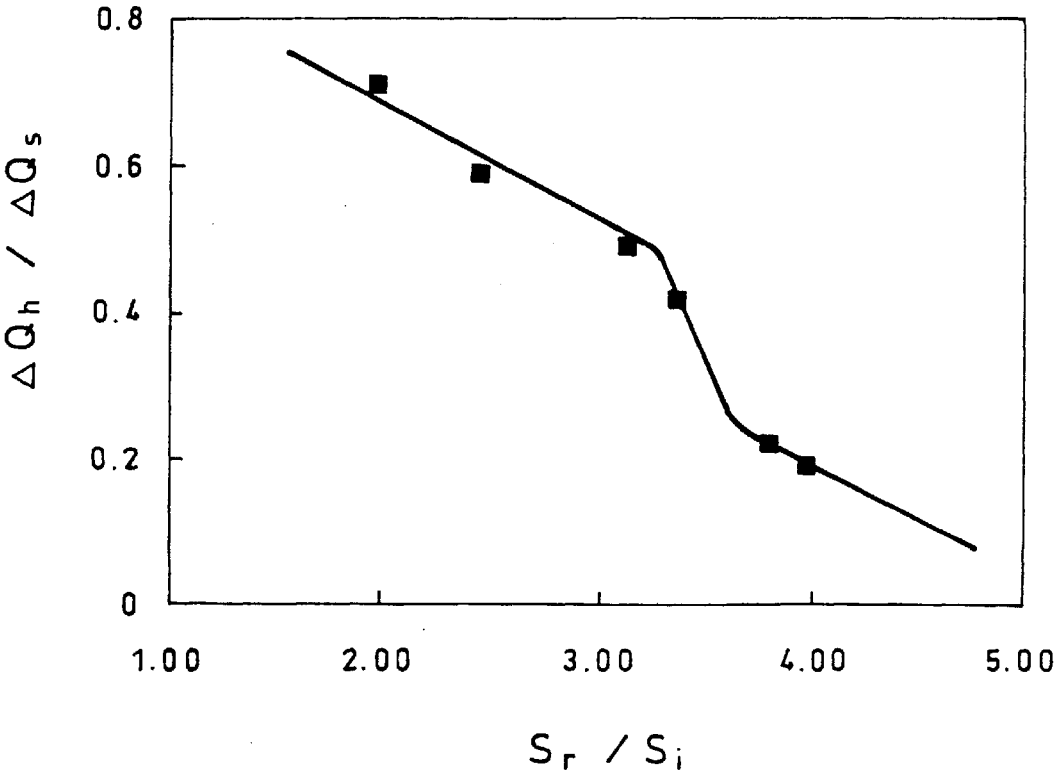
FIG. 2 is a graph of $\Delta Q_h/\Delta Q_s$ which is a ratio of charging rising rates before and after subjecting toner to high temperature, versus $S_r/S_i$ which represents smoothness of toner mother particles.

The following will describe one embodiment of the present invention referring to FIG. 1 and FIG. 2.

Electrophotographic printing-use toner (referred to as toner hereinafter) in accordance with the present invention constitutes two-component developer with magnetic powder carrier (referred to as carrier hereinafter), and is mostly made of binding agent synthetic resin (referred to as binding resin hereinafter). In the binding agent synthetic resin, a charge control agent (charging control agent), a coloring agent, and a parting agent are dispersed so as to form a toner mother particle, and a fluidizing agent is added onto the surface of the toner mother particle.

The present toner is obtained in the following manner. The binding agent synthetic resin, the charge control agent, the coloring agent, and the parting agent are mixed, and the mixture is fused and kneaded in a kneader with heat. Thereafter, the mixture is pulverized after cooling for classification so as to obtain particles having a predetermined average diameter, namely, the toner mother particles are obtained, and the fluidizing agent is added onto the toner mother particles.

The binding agent synthetic resin, which is also known as binder resin, constitutes the main component of the toner, and determines the friction charging, thermal, and mechanical characteristics of the toner. As the binding agent synthetic resin, the following compounds can be adopted: styrene-acryl copolymer, polystyrene, polyester, epoxy, polyamide, polymethyl(meth)acrylate, and polyvinyl butyryl, etc.

The coloring agent determines the color of the toner, and in the case of two-component black toner, a carbon black such as furnace black and channel black are adopted. Also, basic and acidic coloring agents are adopted for positively charged toner and negatively charged toner, respectively.

The charge control agent determines the amount of friction charging in the toner, and for positively charged toner, an electron donor such as quaternary ammonium salt, nigrosine dye, and fatty acid metallic salt are adopted, and for negatively charged toner, an electron receiver such as an azo-containing metallic material, chlorinated paraffin, and chlorinated polyester are adopted.

The parting agent determines the cleaning characteristic, and functions as an offset preventing agent in the case where the toner is heat roller fixing-use toner. As the parting agent, polyolefin wax such as polyethylene wax and polypropylene wax are adopted.

The fluidizing agent is added in order to improve the fluidity of the toner and the cleaning characteristic, and to adjust the amount of friction charging. As the fluidizing agent, fine particles of colloidal silica, titanium oxide, alumina, or fatty acid metallic salt are adopted.

The present toner is manufactured in such a manner that, in order to prevent, without adding a large amount of fluidizing agent, fogging from generating after the toner is subjected to high temperature, the ratio of (a) the charging rate of the toner mother particles maintained at normal temperature with respect to the magnetic powder carrier at the start of mixing and (b) the charging rate of the toner mother particles, at the start of mixing, maintained under the condition of temperature and time which causes aggregation is set in a predetermined range which prevents fogging from generating.

Namely, it was found from the results of an experiment that the relation as shown by the graph of FIG. 1 is established between (a) the ratio $\Delta Q_h/\Delta Q_s$ of the charging rate $\Delta Q_h$ ($\mu$C/g·sec) of the toner mother particles, at the start of mixing, maintained under the condition of temperature and time which causes toner to aggregate to the charging rate $\Delta Q_s$ ($\mu$C/g·sec) of the toner mother particles, with respect to the magnetic powder carrier at the start of mixing, maintained at normal temperature and (b) the fog level which was measured by using, as replenishing toner, toner prepared by adding a small amount of fluidizing agent to the toner mother particles, which was maintained under the condition of temperature and time which causes aggregation (referred to as heat-treated toner hereinafter). Note that, the measuring method of the fog level will be explained later.

As shown by the graph of FIG. 1, the fog level of the heat-treated toner is decreased as the ratio $\Delta Q_h/\Delta Q_s$ increases. From this, it can be seen that the fog level can be reduced by increasing the ratio of $\Delta Q_h/\Delta Q_s$. In particular, when the ratio $\Delta Q_h/\Delta Q_s$ exceeds substantially 0.5, the fog level is significantly reduced.

Therefore, in the present toner, the upper limit of the fog level by which the image can be judged as moderately satisfactory is set to 1.5, and the upper limit of the fog level by which the image can be judged as satisfactory is set to 1.0, and the ratio $\Delta Q_h/\Delta Q_s$ is set so as to be not less than 0.37, more preferably not less than 0.45.

As described, by specifying the ratio of the charging rising rates before and after subjecting toner to high temperature, a sufficient charging ability is maintained even when the toner is subjected to high temperature. Thus, it is possible to prevent fogging from generating after the toner is subjected to high temperature, without adding a large amount of fluidizing agent which has been done conventionally.

It is preferable that the amount of fluidizing agent to be added to the present toner with respect to 100 parts by weight of toner mother particles is in a range of 0.20 part by weight to 0.40 part by weight, and considering the results of measurement of fog level in actual printing (mentioned later), a range of 0.20 part by weight to 0.30 part by weight is preferable. This ensures that the adverse effect caused by excessive addition of the fluidizing agent is avoided.

Further, in the present toner wherein the ratio of charging rising rates before and after subjecting the toner to high temperature is set, and a predetermined amount of fluidizing agent is added, as will be mentioned later, even when the toner is subjected to a high temperature of, for example, 50° C. for 2 days (48 hours), it is possible to obtain a desirable image in printing.

Note that, although the upper limit of the ratio $\Delta Q_h/\Delta Q_s$ was not mentioned above, the ratio $\Delta Q_h/\Delta Q_s$ has an upper limit value close to 1 but not exceeding 1.

Also, when determining the ratio of $\Delta Q_h/\Delta Q_s$, the condition of temperature and time which causes the toner to aggregate is 50° C. (±5° C.) and at least 48 hours or longer. These values are set by taking into account of a high temperature condition, as mentioned above, which might occur during shipment, and the adverse effect such condition causes.

The following describes specifically how the ratio of charging rising rates before and after subjecting the toner to high temperature is set in the above range.

As described, the charging rate is changed in accordance with the degree of aggregation when subjecting the toner to high temperature, and the degree by which the toner is aggregated depends on the smoothness of the toner surface. Namely, when more irregularities are found on the surfaces of the toner mother particles, when exposed to high temperature, adjacent toner mother particles are more likely to be deformed in accordance with the irregularities, and the irregularities between adjacent toner mother particles are interlocked. When the temperature returns to normal, the adjacent toner mother particles interlocked by the irregularities are combined with each other at the interface, resulting in aggregation. On the other hand, when the surfaces of the toner mother particles are smooth with less irregularities, adjacent toner mother particles are less likely to be interlocked by the irregularities, and the fluidity is maintained even at high temperature so that aggregation is less likely to occur.

Thus, it can be said that the degree by which the toner mother particles are aggregated is dependent on the smoothness of the surfaces of the toner mother particles, and therefore by setting the smoothness of the surfaces of the toner mother particles so that the predetermined range of the ratio $\Delta Q_h/\Delta Q_s$ is satisfied, it is possible to realize toner having a ratio $\Delta Q_h/\Delta Q_s$ in the above range.

The smoothness of the toner mother particles can be represented by the ratio $S_r/S_i$, where $S_i$ is a specific surface area of a group of the toner mother particles which is obtained by measuring the volume sphere equivalent diameter of each toner mother particle with respect to the group of toner mother particles by Coulter Counter, etc., and by calculating the surface area of the group of toner mother particles as a sphere having a diameter of the volume sphere equivalent diameter, and $S_r$ is the specific surface area of the group of toner mother particles as measured by the BET method.

From the results of the measurement, it was found that the ratio $\Delta Q_h/\Delta Q_s$ and the ratio $S_r/S_i$ are related to each other as shown by the graph of FIG. 2. As it can be seen from the graph of FIG. 2, as the ratio of $S_r/S_i$ is increased, the ratio of $\Delta Q_h/\Delta Q_s$ decreases. In particular, when the ratio $S_r/S_i$ exceeds 3.00, the ratio $\Delta Q_h/\Delta Q_s$ is suddenly decreased. As the value of the ratio $S_r/S_i$ approaches 1, the difference between $S_r$ and $S_i$ becomes smaller, namely, the surfaces of the toner mother particles become smoother.

Thus, in accordance with the above relation, the present toner is manufactured so that the ratio of $S_r/S_i$ is not more than 3.50 ($\Delta Q_h/\Delta Q_s$ is not less than 0.37), more preferably not more than 3.30 ($\Delta Q_h/\Delta Q_s$ is not less than 0.45).

The following describes toner of the present embodiment using a specific example.

First, the materials shown with the formula in Table 1 were mixed together using Henschel mixer, and the mixture thus obtained was fused and kneaded by the sequential biaxial plodding kneader and was cooled. Then, the mixture was pulverized by a jet mill under various conditions and was classified, thus obtaining six types of toner mother particles A to F with different particle shapes having an average particle diameter of 11.0 $\mu$m. Hereinafter, the toner mother particles A to F will be referred to as uncoated toner.

TABLE 1

| Material Name | Percent by Weight |
|---|---|
| Binding Agent Synthetic Resin | |
| Styrene-Acryl Copolymer | 100.0 |
| Coloring Agent | |
| Carbon Black | 6.0 |
| Charge Control Agent | |
| Quaternary Ammonium Salt | 3.0 |
| Parting Agent | |
| Polyethylene Wax | 2.0 |
| Polypropylene Wax | 3.0 |

Table 2 shows the results of the measurement of the ratio $\Delta Q_h/\Delta Q_s$ and the ratio $S_r/S_i$ with respect to the six types of the uncoated toner A to F.

TABLE 2

| Types of Uncoated toner | $\Delta Q_h/\Delta Q_s$ | $S_r/S_i$ |
|---|---|---|
| A | 0.42 | 3.27 |
| B | 0.49 | 3.10 |
| C | 0.59 | 2.43 |
| D | 0.71 | 1.96 |
| E | 0.22 | 3.78 |
| F | 0.19 | 3.95 |

The ratio $\Delta Q_h/Q_s$ was determined in the following manner. First, each of (1) uncoated toner maintained at normal temperature and (2) the same uncoated toner maintained at 50° C. for 48 hours was mixed with ferrite carrier having an average diameter of 90 $\mu$m in a ball mill with a toner content of 4.2 percent by weight. Then, the charged amount Q($\mu$C/g) with respect to the mixing time t (sec) was measured by the blowoff method, and the resulting value was approximated to Equation (1) by the method of least squares so as to determine constants $Q_a$ ($\mu$C/g) and $\tau$ (sec) for each toner.

$$Q=Q_a(1-\exp(-t/\tau)) \quad (1)$$

Then, using the constants $Q_a$ ($\mu$C/g) and $\tau$ (sec) thus determined, from Equation (2), the charging rate $Q_s$ ($\mu$C/g·sec) at the start of mixing was determined for each toner.

$$\Delta Q=(dQ/dt)_{t=O}Q_a/\tau \quad (2)$$

In this manner, $\Delta Q_s$, which is a charging rate of the uncoated toner, at the start of mixing, maintained at normal temperature, and $\Delta Q_h$, which is a charging rate of the uncoated toner, at the start of mixing, subjected to heat-treatment were determined, thus obtaining the ratio of $\Delta Q_h/\Delta Q_s$.

Also, when determining the ratio of $S_r/S_i$, the volume sphere equivalent diameter of each uncoated toner in a group of uncoated toner was determined using Coulter Counter.

Then, silica (fluidizing agent) was added to each of the six types of uncoated toner A to F whose ratios $\Delta Q_h/\Delta Q_s$ have been determined so as to prepare samples, and in the following manner, the fogging was evaluated by measuring the fog level after maintaining the samples at high temperature. Table 3 shows the formula of each sample and the results of the measurement. Table 3 also shows the results of fog evaluation wherein the fog level in actual printing was measured with respect to the predetermined samples at the initial, one hundred thousand, two hundred thousand, and three hundred thousand prints. Note that, in the evaluation of fogging, the fog level was measured using the sample toner maintained at normal temperature, which is generally adopted in actual printing.

TABLE 3

| SAMPLE | $\Delta Q_h/\Delta Q_s$ | TYPE OF UNCOATED TONER | AMOUNT OF SILICA FINE PARTICLES ADDED | FOG LEVEL OF HEAT-TREATED TONER | EVALUATION | FOG LEVEL IN ACTUAL PRINTING AND EVALUATION: INITIAL | EVALUATION | 100,000 | EVALUATION | 200,000 | EVALUATION | 300,000 | EVALUATION |
|---|---|---|---|---|---|---|---|---|---|---|---|---|---|
| #1 | 0.42 | A | 0.30 | 1.41 | Δ | 0.46 | ○ | 0.49 | ○ | 0.41 | ○ | 0.46 | ○ |
| #2 | 0.42 | A | 0.40 | 1.20 | Δ | 0.61 | ○ | 0.58 | ○ | 0.59 | ○ | 0.69 | ○ |
| #3 | 0.49 | B | 0.30 | 0.84 | ○ | 0.46 | ○ | 0.41 | ○ | 0.45 | ○ | 0.46 | ○ |
| #4 | 0.49 | B | 0.40 | 0.69 | ○ | 0.56 | ○ | 0.51 | ○ | 0.55 | ○ | 0.68 | ○ |
| #5 | 0.59 | C | 0.30 | 0.78 | ○ | 0.48 | ○ | 0.49 | ○ | 0.45 | ○ | 0.51 | ○ |
| #6 | 0.59 | C | 0.40 | 0.66 | ○ | 0.61 | ○ | 0.59 | ○ | 0.55 | ○ | 0.71 | ○ |
| #7 | 0.71 | D | 0.30 | 0.69 | ○ | 0.44 | ○ | 0.41 | ○ | 0.41 | ○ | 0.45 | ○ |
| #8 | 0.71 | D | 0.40 | 0.63 | ○ | 0.58 | ○ | 0.61 | ○ | 0.62 | ○ | 0.69 | ○ |
| #9 | 0.22 | E | 0.30 | 3.24 | X | — | | — | | — | | — | |
| #10 | 0.22 | E | 0.40 | 2.95 | X | — | | — | | — | | — | |
| #11 | 0.19 | F | 0.30 | 4.62 | X | — | | — | | — | | — | |
| #12 | 0.19 | F | 0.40 | 3.43 | X | — | | — | | — | | — | |
| #13 | 0.49 | B | 0.50 | 0.89 | ○ | 2.64 | X | 1.98 | X | 2.01 | X | 2.36 | X |
| #14 | 0.49 | B | 0.60 | 0.96 | ○ | 3.52 | X | 2.97 | X | 2.81 | X | 3.11 | X |

(IN THE TABLE , ○, Δ, AND X REPRESENT RESULTS OF EVALUATION OF FOGGING IN IMAGE QUALITY, WHERE ○ INDICATES "SATISFACTORY", Δ INDICATES "TOLERABLE IN ACTUAL USE", AND X INDICATES "INTOLERABLE IN ACTUAL USE".)

First, to each uncoated toner was added 0.30 part by weight of silica with respect to 100 parts by weight of the uncoated toner, and in a V-shaped mixer, ferrite carrier having an average diameter of 90 $\mu$m was mixed with the mixture thus prepared with a toner content of 4.2 percent by weight so as to prepare initial developer samples of the uncoated toner A to F.

Also, to each of the six types of uncoated toner A to F was added silica with the formula of Table 3 with respect to 100 parts by weight of the uncoated toner so as to prepare replenishing-use developer samples #1 to #14, and the samples #1 to #14 thus prepared were maintained at 50° C. for 48 hours so as to obtain heat-treated toner of each of the samples #1 to #14.

Then, using a copying machine SD-2260 (provided by Sharp Corporation), each heat-treated toner of the samples #1 to #14 was inserted into the toner hopper, and the initial developer samples corresponding to the samples #1 to #14, namely, initial developer samples made of the same uncoated toner A to F were added to the developer tank.

Then, immediately after the READY sign, 10 prints of black were made on a copying paper of A3 size. Thereafter, 20 prints of a document which is a white paper of A4 size on which a black band having a width of 3 cm is provided on the center were made on a copying paper whose brightness has been measured by the Hunter brightness meter (provided by Nippon Denshoku Kogyo Co., Ltd.) so as to measure the brightness of the white portion of each of resulting 20 copying papers. The difference between the brightness after printing thus measured and the brightness before printing was determined, and the degree by which the brightness lowered by printing was defined as a fog level, and the average of the fog levels of the 20 prints was taken with respect to each of the samples #1 to #14.

In the above measurement of the fog level of the heat-treated toner, a large amount of toner in the developer tank is consumed in printing of black immediately after the READY sign. As a result, the toner concentration is suddenly reduced, and replenishing of toner from the toner hopper is started. In the following process of printing of the document provided with a black portion on the center, the toner concentration in the developer tank corresponding to the center of the document is reduced, and nonuniformity of toner concentration is induced in the developer tank, and toner is replenished under this condition. When the toner is replenished under this condition, the toner concentration in the developer tank corresponding to the white portion of the document is increased in comparison to the toner concentration corresponding to the black portion. As a result, fogging is more likely to be caused on the white portion. Thus, by the described measurement of the fog level, it is possible to evaluate initial fogging under demanding conditions.

In the measurement of fog level in actual printing, although the definition of the fog level is the same, more specifically, the fog level was measured by copying one after another a character document whose character content with respect to a paper of A4 size is 6 percent by the copying machine SD-2260 (provided by Sharp Corporation) until a total of three hundred thousand copies were made, and the document for measurement of the fog level was copied per one hundred thousand copies.

As shown in Table 3, in the samples #9 to #12 employing the uncoated toner E and F, whose ratios of $\Delta Q_h/\Delta Q_s$ are smaller than 0.37, the values of the fog level of the heat-treated toner were larger than 1.5, and the image quality was significantly poor due to fogging.

In contrast, in the samples #1 to #8, and the samples #13 and #14 employing the uncoated toner A to D, whose ratios Of $\Delta Q_h/\Delta Q_s$ are larger than 0.37, the fog levels of the heat-treated toner were smaller than 1.5, and a desirable image was obtained. However, in the sample #1 and #2 whose ratios of $\Delta Q_h/\Delta Q_s$ are 0.42, although an image tolerable in an actual use was obtained, lowering of image quality was observed compared with the samples #3 to #8 and the samples #13 and #14.

Also, among the samples #3, #4, #13, and #14 made of the same uncoated toner B, in the samples #13 and #14 to which not less than 0.50 part by weight of silica (fluidizing agent) with respect to 100 parts by weight of uncoated toner is added, it was found that the value of fog level in actual printing was high, and that the fogging was generated due to excessive addition of silica.

Also, as a result of comparing the samples #1 and #2, the samples #3 and #4, the samples #5 and #6, and the samples #7 and #8, it was found that, even when the same uncoated toner is used, although the fog level of the heat-treated toner can be suppressed as the amount of silica added was increased, the fog level in actual printing was increased as a larger amount of silica was added.

As described, the electrophotographic printing-use toner of the present invention has an arrangement wherein the ratio of $\Delta Q_h/\Delta Q_s$ is set in a predetermined range which does not cause fogging, where $\Delta Q_s$ is the charging rate of the toner mother particles, at the start of mixing, maintained at normal temperature with respect to the magnetic powder carrier, and $\Delta Q_h$ is the charging rate of the toner mother particles, at the start of mixing, maintained under the condition of temperature and time which causes the electrophotographic printing-use toner to aggregate.

With this arrangement, since the ratio of charging rising rates before and after subjecting toner mother particles to high temperature is specified, even when exposed to high temperature, a sufficient charging ability is maintained.

As a result, it is possible to prevent fogging from generating in a use after the toner is maintained at high temperature, without inducing the adverse effect caused by excessive addition of the fluidizing agent.

The electrophotographic printing-use toner of the present invention has an arrangement wherein the ratio of $S_r/S_i$ is set in a range which does not cause fogging, where $S_i$ is the specific surface area of a group of toner mother particles which is obtained by measuring the volume sphere equivalent diameter of each toner mother particle with respect to a group of toner mother particles, and by calculating the surface area of the group of toner mother particles as a sphere having a diameter of the volume sphere equivalent diameter, and $S_r$ is the specific surface area of the group of toner mother particles as measured by the BET method.

With this arrangement, since the smoothness of the surfaces of the toner mother particles are specified, even when exposed to high temperature, the toner is less likely to aggregate.

As a result, it is possible to prevent fogging from generating in a use after the toner is maintained at high temperature, without inducing the adverse effect caused by excessive addition of the fluidizing agent.

The electrophotographic printing-use toner of the present invention has an arrangement wherein the amount of fluidizing agent added is not more than 0.40 part by weight with respect to 100 parts by weight of the toner mother particles.

With this arrangement, since the amount of fluidizing agent added is specified, it is ensured that the adverse effect caused by excessive addition of the fluidizing agent is prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Electraphotographic printing-use toner constituting two-component developer with magnetic powder carrier, comprising:

toner mother particles including binding resin and a coloring agent;

a fluidizing agent added onto surfaces of the toner mother particles;

wherein a ratio of $\Delta Q_h/\Delta Q_s$ is set in a predetermined range which does not cause fog, $\Delta Q_s$ being a charging rate of said toner mother particles maintained at normal temperature with respect to the magnetic powder carrier at a start of mixing, $\Delta Q_h$ being a charging rate of said toner mother particles, at a start of mixing, maintained under a condition of temperature and time which causes said electrophotographic printing-use toner to aggregate;

wherein the ratio of $\Delta Q_h/\Delta Q_s$ is not less than 0.37; and wherein an amount of said fluidizing agent added is not more than 0.40 part by weight with respect to 100 parts by weight of said toner mother particles.

2. The electrophotographic printing-use toner as set forth in claim 1, wherein the ratio of $\Delta Q_h/\Delta Q_s$ is not less than 0.45.

3. The electrophotographic printing-use toner as set forth in claim 1, wherein an amount of said fluidizing agent added is in a range of 0.2 part by weight to 0.3 part by weight with respect to 100 parts by weight of said toner mother particles.

4. Electrophotographic printing-use toner constituting two-component developer with magnetic powder carrier, comprising:

toner mother particles including binding resin and a coloring agent;

a fluidizing agent added onto surfaces of said toner mother particles;

wherein a ratio of $S_r/S_i$ is set in a predetermined range which does not cause fog, $S_i$ being a specific surface area of a group of said toner mother particles, which is obtained by measuring a volume sphere equivalent diameter of each of said toner mother particles with respect to the group of said toner mother particles, and by calculating a surface area as a sphere having a diameter of the volume sphere equivalent diameter, $S_r$ being a specific surface area of the group of said toner mother particles as measured by a BET method;

wherein the ratio of $S_r/S_i$ is not more than 3.50; and wherein an amount of said fluidizing agent added is not more than 0.40 part by weight with respect to 100 parts by weight of said toner mother particles.

5. The electrophotographic printing-use toner as set forth in claim 4, wherein the ratio of $S_r/S_i$ is not more than 3.30.

6. The electrophotographic printing-use toner as set forth in claim 4, wherein an amount of said fluidizing agent added is in a range of 0.2 part by weight to 0.3 part by weight with respect to 100 parts by weight of said toner mother particles.

7. A method for manufacturing electrophotographic printing-use toner constituting two-component developer composed of (i) toner mother particles containing binding resin and (ii) magnetic powder carrier, comprising the steps of:

forming the toner mother particles so that a ratio of $\Delta Q_h/\Delta Q_s$ it not less than 0.37;

where $\Delta Q_s$ is a charging rate of the toner mother particles maintained at normal temperature with respect to the magnetic powder carrier at a start of mixing, and $\Delta Q_h$ is a charging rate of the toner mother particles, at a start of mixing, maintained under a condition of temperature and time which causes said electrophotographic printing-use toner to aggregate; and adding a fluidizing agent onto surfaces of the toner mother particles so that an amount of the fluidizing agent added with respect to 100 parts by weight of the toner mother particles is not more than 0.40 part by weight.

8. A method for manufacturing electrophotographic printing-use toner including toner mother particles containing binding resin, comprising the steps of:

forming the toner mother particles so that a ratio of $S_r/S_i$ not more than 3.50;

where $S_i$ is a specific surface area of a group of the toner mother particles, which is obtained by measuring a volume sphere equivalent diameter of each of the toner mother particles with respect to the group of the toner mother particles, and by calculating a surface area as a sphere having a diameter of the volume sphere equivalent diameter, and $S_r$ is a specific surface area of the group of the toner mother particles as measured by a BET method; and adding a fluidizing agent onto surfaces of the toner mother particles so that an amount of the fluidizing agent added with respect to 100 parts by weight of the toner mother particles is not more than 0.40 part by weight.

* * * * *